US005666424A

United States Patent [19]

Fosgate et al.

[11] Patent Number: 5,666,424

[45] Date of Patent: Sep. 9, 1997

[54] SIX-AXIS SURROUND SOUND PROCESSOR WITH AUTOMATIC BALANCING AND CALIBRATION

[75] Inventors: James W. Fosgate, Heber City; Samuel John Wolfe, Park City, both of Utah

[73] Assignee: Harman International Industries, Inc., Northridge, Calif.

[21] Appl. No.: 637,071

[22] Filed: Apr. 24, 1996

Related U.S. Application Data

[63] Continuation-in-part of Ser. No. 624,907, Mar. 27, 1996, which is a continuation of Ser. No. 276,901, Jul. 18, 1994, Pat. No. 5,504,819, which is a continuation-in-part of Ser. No. 990,660, Dec. 14, 1992, Pat. No. 5,428,687, which is a continuation-in-part of Ser. No. 533,091, Jun. 8, 1990, Pat. No. 5,172,415.

[51] Int. Cl.[6] ..... H04R 5/00

[52] U.S. Cl. ..... 381/18; 381/22; 381/107; 381/104

[58] Field of Search ..... 381/18, 1, 17, 381/19, 22, 21, 23, 20, 104, 107, 108

[56] References Cited

U.S. PATENT DOCUMENTS

| | | | |
|---|---|---|---|
| 3,281,534 | 10/1966 | Dersch . | |
| 3,632,886 | 1/1972 | Scheiber . | |
| 3,708,631 | 1/1973 | Bauer et al. . | |
| 3,710,023 | 1/1973 | Greuzard, Sr. et al. . | |
| 3,746,792 | 7/1973 | Scheiber . | |
| 3,836,715 | 9/1974 | Ito et al. . | |
| 3,864,516 | 2/1975 | Kameoka et al. . | |
| 3,883,692 | 5/1975 | Tsurushima . | |
| 3,883,832 | 5/1975 | Fosgate . | |
| 3,885,099 | 5/1975 | Tsurushima et al. . | |
| 3,943,287 | 3/1976 | Gravereaux et al. . | |
| 3,944,735 | 3/1976 | Willcocks . | |
| 3,969,588 | 7/1976 | Raydon et al. . | |
| 3,982,071 | 9/1976 | Weiss et al. . | |
| 3,989,903 | 11/1976 | Cooper et al. . | |
| 4,054,804 | 10/1977 | Tanaka . | |
| 4,704,728 | 11/1987 | Scheiber . | |
| 4,891,839 | 1/1990 | Scheiber . | |
| 4,932,059 | 6/1990 | Fosgate | 381/22 |
| 4,941,177 | 7/1990 | Mandell et al. . | |
| 4,953,213 | 8/1990 | Tasaki et al. . | |
| 5,027,687 | 7/1991 | Iwamatsu . | |
| 5,028,824 | 7/1991 | Young . | |
| 5,073,945 | 12/1991 | Kageyama et al. . | |
| 5,136,650 | 8/1992 | Griesinger | 381/22 |
| 5,172,415 | 12/1992 | Fosgate | 381/22 |
| 5,216,718 | 6/1993 | Fukuda . | |
| 5,263,087 | 11/1993 | Fosgate | 381/22 |
| 5,428,687 | 6/1995 | Willcocks et al. | 381/22 |
| 5,504,819 | 4/1996 | Fosgate | 381/22 |

OTHER PUBLICATIONS

Integrated Electronics, *The Volt–Ampere Characteristic*, Sec. 3–4.

Spice for Circuits And Electronics Using Pspice, Muhammad H. Rashid, pp. 1–118.

Envelope Generators & Sequencers For Electronic Music, Don Lancaster, Popular Electronics, Jan. 1976, pp. 58–62.

*Primary Examiner*—Minsun Oh

*Attorney, Agent, or Firm*—Haynes and Boone, L.L.P.

[57] ABSTRACT

A surround sound processor system for multichannel redistribution of stereophonic signals has digitally controlled gains in each input and each output channel, controlled by a microprocessor, which receives an input signal from a microphone placed at the preferred listening location within the listening area for automatically balancing the input signals and setting both input and output gains during a calibration process so as to provide the listener with the best possible surround sound reproduction of the stereophonic source material. As a visual aid, the microprocessor displays menus and messages on a video screen, and a visual display shows the relative levels of the six axes of control signals within the surround sound processor.

13 Claims, 9 Drawing Sheets

SIX-AXIS SURROUND SOUND PROCESSOR WITH AUTOMATIC BALANCING AND CALIBRATION

CROSS REFERENCE TO RELATED APPLICATIONS

This application is a continuation-in-part of co-pending patent application Ser. No. 08/624,907, entitled "Surround Sound Processor with Improved Control Voltage Generator, filed on Mar. 27, 1996, which is a continuation of Ser. No. 276,901, filed Jul. 18, 1994 U.S. Pat. No. 5,504,819, issued on Apr. 2, 1996, entitled "Surround Sound Processor with Improved Control Voltage Generator," which is a continuation-in-part of U.S. Pat. No. 5,428,687, issued on Jun. 27, 1995 from U.S. patent application Ser. No. 07/990,660, filed Dec. 14, 1992, entitled "Control Voltage Generator Multiplier and One-Shot for Integrated Surround Sound Processor," which is a continuation-in-part of U.S. Pat. No. 5,172,415, issued on Dec. 15, 1992 from U.S. patent application Ser. No. 07/533,091, filed Jun. 8, 1990.

BACKGROUND OF THE INVENTION

The present invention relates in general to processors for the periphonic reproduction of sound. More specifically, the invention relates to a microprocessor-controlled electronic calibration and balancing system for adjustment of the individual channel gains of a surround sound processor for multichannel redistribution of audio signals so as to provide the listener with the optimum system performance at his actual position within the listening area of a multichannel audio amplifier and loudspeaker system incorporating the surround sound processor. The invention relates further to a visual display system for indicating to the listener the relative strengths of the six-axis control signals generated within the surround sound processor.

A surround sound processor operates to enhance a two-channel stereophonic source signal so as to drive a multiplicity of loudspeakers arranged to surround the listener, in a manner to provide a high-definition soundfield directly comparable to discrete multitrack sources in perceived performance. An illusion of space may thus be created enabling the listener to experience the fullness, directional quality and aural dimension or "spaciousness" of the original sound environment. The foregoing so-called periphonic reproduction of sound can be distinguished from the operation of conventional soundfield processors which rely on digitally generated time delay of audio signals to simulate reverberation or "ambience" associated with live sound events. These conventional systems do not directionally localize sounds based on information from the original performance space and the resulting reverberation characteristics are noticeably artificial.

To accomplish this end, a surround sound processor typically comprises an input matrix, a control voltage generator and a variable matrix circuit. The input matrix usually provides for balance and level control of the input signals, generates normal and inverted polarity versions of the input signals, plus sum and difference signals, and in some cases generates phase-shifted versions, and/or filters the signals into multiple frequency ranges as needed by the remainder of the processing requirements. The control voltage generator includes a directional detector and a servologic circuit. The directional detector measures the correlations between the signals which represent sounds encoded at different directions in the stereophonic sound stage, generating voltages corresponding to the predominant sound directional location. The servologic circuit uses these signals to develop control voltages for varying the gain of voltage controlled amplifiers in the variable matrix circuit in accordance with the sound direction and the direction in which it is intended to reproduce the sound in the surrounding loudspeakers.

The variable matrix circuit includes voltage-controlled amplifiers and a separation matrix. The voltage-controlled amplifiers amplify the input matrix audio signals with variable gain, for application to the separation matrix, where they are used to selectively cancel crosstalk into different loudspeaker feed signals. The separation matrix combines the outputs of the input matrix and of the voltage-controlled amplifiers in several different ways, each resulting in a loudspeaker feed signal, for a loudspeaker to be positioned in one of several different locations surrounding the listener. In each of these signals, certain signal components may be dynamically eliminated by the action of the detector, control voltage generator, voltage-controlled amplifiers (VCA's) and separation matrix.

In surround sound processors, much of the subtleties of the presentation are due to the characteristics of the direction detector and servologic circuit of the control voltage generator and of the VCA's. As these are further refined, the apparent performance becomes more transparent and effortless-sounding to the listener.

To attain a more accurate presentation of the multichannel sound to the listener, when the sound is presented through multiple amplifiers and loudspeakers which surround the listener, it is necessary to calibrate the system by adjusting the gain of each channel so that it has the same relative acoustic effect at the listener's position within the listening area. Hitherto, this has been done by manual adjustments of the channel gains when each in turn is provided with a shaped noise signal.

Therefore, what is needed is an automatic calibration and balancing system for adjusting the gains of each of the input and output channels of the surround sound processor so as to attain the optimum performance at a listener's position within the listening area of the multichannel amplifier and loudspeaker system used for acoustical presentation of the output signals of the surround sound processor.

SUMMARY OF THE INVENTION

To this end the present invention provides an improved surround processor with an automatic calibration and balancing system incorporating a microprocessor, for adjusting the gains of each of the input and output channels of the surround sound processor so as to attain the optimum performance at a listener's position within the listening area of the multichannel amplifier and loudspeaker system used for acoustical presentation of the output signals of the surround sound processor.

In another aspect, the invention provides a visual display indicating to the listener the instantaneous relative strengths of each of the six control signals, one for each axis, provided by the direction detector and detector splitter circuitry of the six-axis surround sound processor.

In one embodiment, a surround sound processor system for multichannel redistribution of sound for reproduction by a plurality of loudspeakers surrounding a listener is provided. The system includes a plurality of stereo audio inputs for receiving stereo audio signals from one or more source units; a selection arrangement for selecting one of the plurality of stereo audio signals as a left and a right channel audio input signal; a digitally controlled gain adjustment circuit in each of the left and right channels for controlling the amplitudes of the audio input signals; a surround sound processor for combining the left and right audio input signals in fixed and varying proportions according to the directional information contained therein by virtue of the instantaneous relative magnitudes and phases of the left and right audio input signals which is detected by a direction detector arrangement, and which is combined in a matrix circuit including voltage controlled amplifiers which are controlled by a multiplicity of control voltage signals derived from the output signals of the direction detector after these have passed through a detector splitter and a servo-logic circuit for controlling the attack and decay time constants associated therewith, to provide at the outputs of the surround sound processor a plurality of loudspeaker drive signals; a plurality of digitally controlled attenuator circuits equal to the plurality of loudspeaker drive signals for adjustment of the output signal level of each of the digitally controlled attenuator circuits; a calibration signal source; a microphone for placement at a point in the area surrounded by the plurality of loudspeakers; a preamplifier and level detector circuit for receiving the input from the microphone and producing therefrom a direct voltage proportional to the sound intensity at the location of the microphone and converting said direct voltage to a digital signal; and a microprocessor controller so configured in a calibration mode as to receive said digital signal from the microphone and to automatically adjust the gains of each in turn of the plurality of digitally controlled attenuators when the output of the calibration signal is applied thereto so that the sound intensity due to each of the plurality of loudspeakers at the microphone position is the same.

An advantage achieved with the invention is ease of consumer use in calibrating a surround sound system whereby the outputs are automatically balanced precisely to provide a more accurate reproduction of the multichannel sound at the actual listener's position.

Another advantage achieved is that the visual display to the listener of the relative strengths of the six axis control signals that control the redistribution of stereophonic sound into a multichannel soundfield ensures the listener as to the accuracy of, and changes in, the calibration.

DETAILED DESCRIPTION OF THE INVENTION

The principal new features of the present invention are an automatic calibration and balancing system incorporating a microprocessor and used in conjunction with a microphone to adjust the input and output levels of each channel so as to provide the optimism acoustical performance for each different input source at the actual listening position; an improved digitally controlled automatic input balancing system; and a visual display indicating the relative strengths of the six axis control signals.

Figure 1:
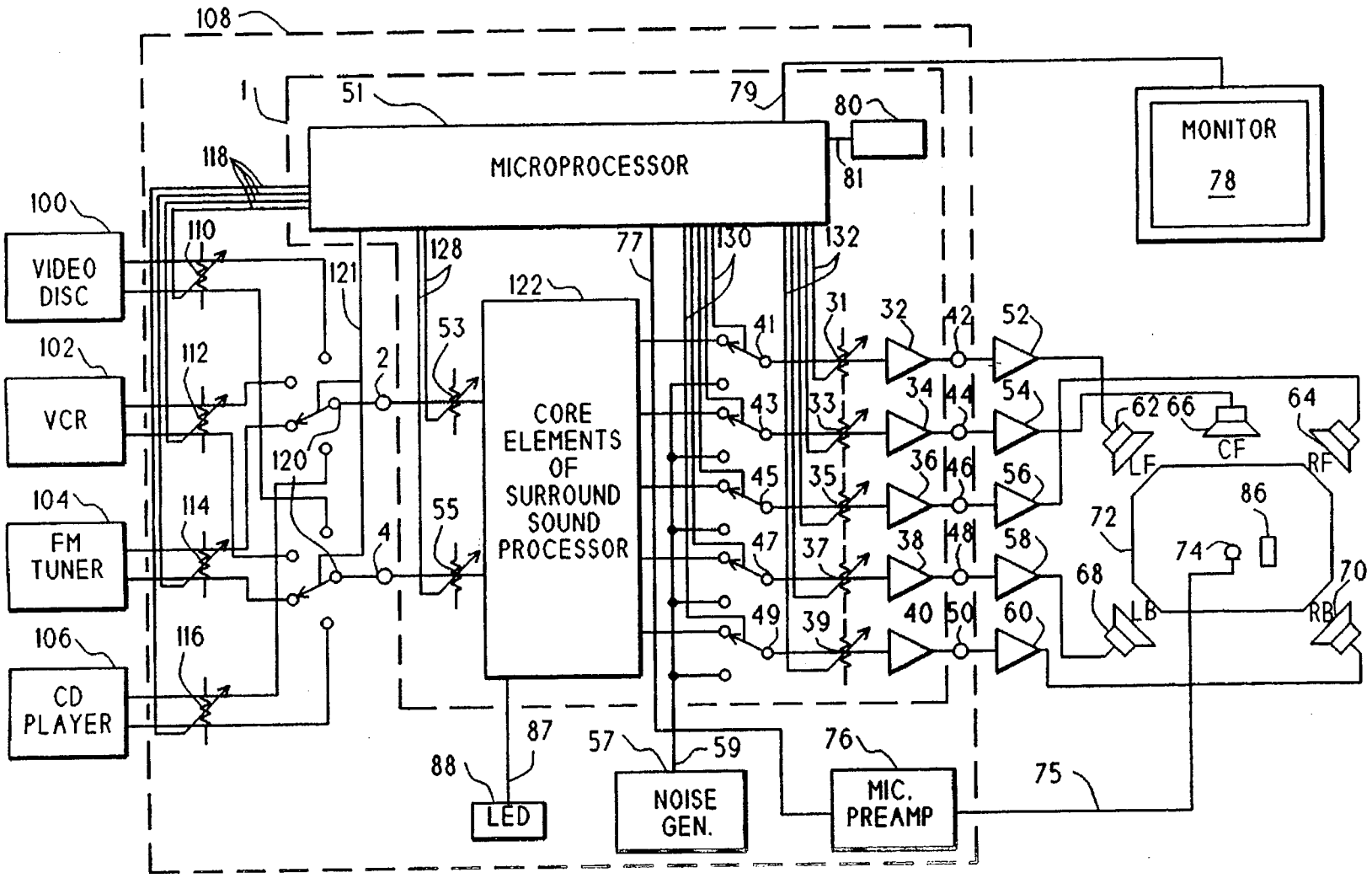
FIG. 1 is a block schematic of a surround sound system including a surround sound processor according to the invention with amplifiers and loudspeakers surrounding a listening area and a microphone placed within the listening area.

Referring to FIG. 1, there is shown a typical surround sound system for presentation of multiple channels of audio on a plurality of loudspeakers surrounding a listener, wherein a surround sound processor redistributes the audio signals present in the stereophonic or multichannel matrixed source among the several loudspeaker output signals to produce a soundfield surrounding the listening area.

Figure 2:
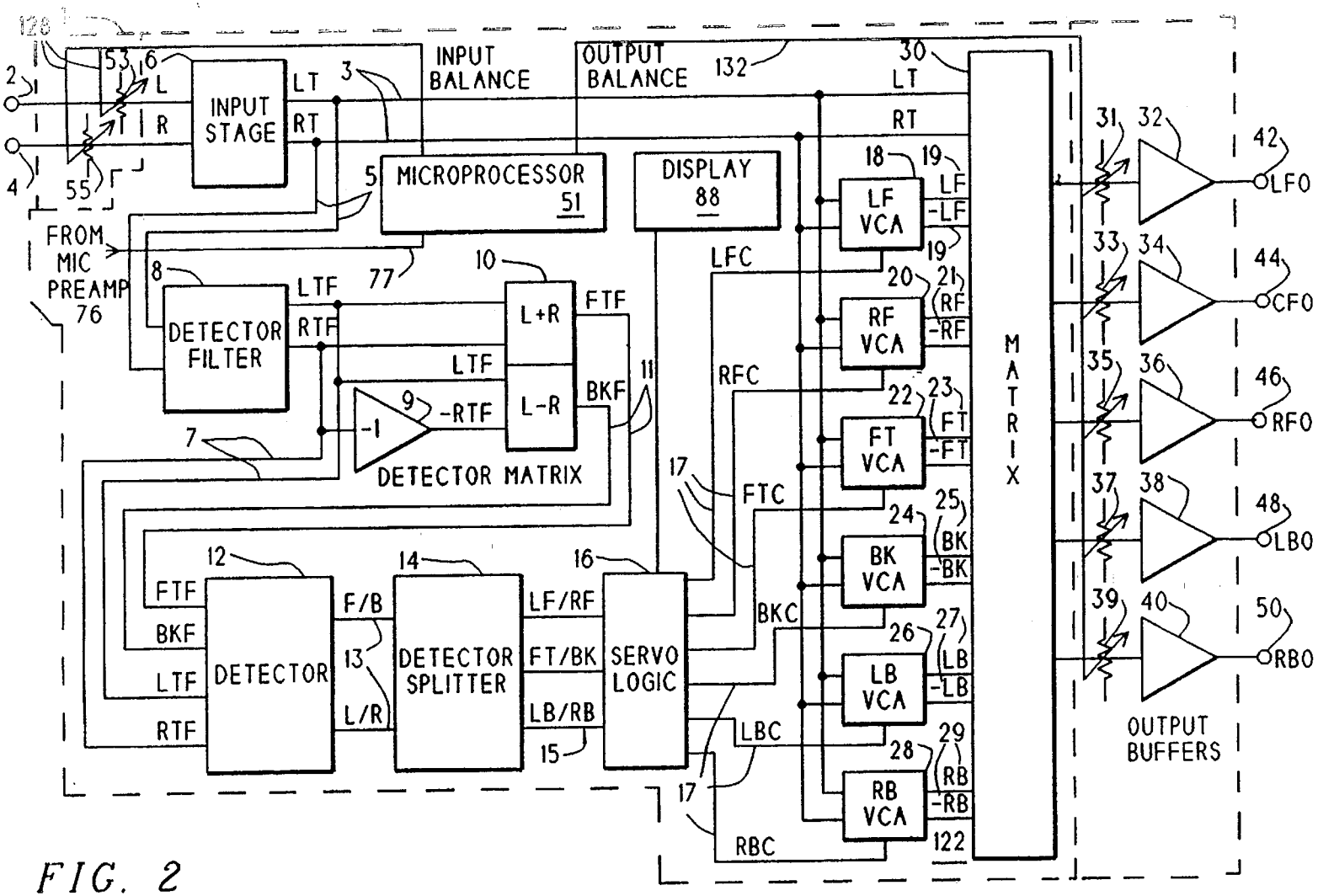
FIG. 2 is a block schematic of a six-axis surround sound processor according to the invention, incorporating a microprocessor for automatic balancing and calibration as employed in the system of FIG. 1.

In PIG. 1, a surround sound system controller unit 108 including a surround sound processor 1 is configured to receive stereophonic or monophonic signals from one or more audio/video sources, such as a video disc player 100, a video cassette recorder (VCR) 102, an FM tuner 104, and a compact disc player 106, (video and other audio inputs not shown). Each of these stereophonic audio signals passes through an input gain adjustment circuit 110–116 controlled by the signals 118 to a selector switch 120 controlled by signal line 121, and thence to the left and right input terminals 2 and 4 of the surround sound processor 1. The processor 1 is shown in FIG. 2, and numbering of the elements shown therein has been made to correspond as far as possible to the numbering employed in FIG. 1 of co-pending patent application Ser. No. 08/624,907 referred to above. As will be further described below, the gain controls 110–116 may be combined with those labeled 53 and 55.

The core elements of processor I are the circuitry which processes the stereophonic input audio signals for multichannel redistribution into multiple loudspeakers surrounding the listener. These core elements are represented by the block 122 of FIG. I which as shown in FIG. 2 contains an input stage 6, detector filter 8, inverter 9, detector matrix 10, direction detector 12, detector splitter 14, servologic circuit 16, voltage controlled amplifiers (VCA's) 18, 20, 22, 24, 26 and 28, and a separation matrix 30.

Outside the core elements of the block 122 but still forming part of the surround sound processor block 1 are the input attenuators 53, 55, controlled by signals 122 and used to balance the input signals applied to terminals 2,4, and the output buffers 32, 34, 36, 38 and 40, which provide loudspeaker feed signals LFO, CFO, RFO, LBO and RBO at terminals 42, 44, 46, 48 and 50, respectively, of processor 1.

A microprocessor 51, input balancing attenuators 53 and 55 and output level adjustments 31, 33, 35, 37 and 39 controlled thereby through lines 132 have been added within the surround sound processor 1 and are also shown in FIG.

2. A multi-pole switch 41, 43, 45, 47 and 49 controlled by the microprocessor 51 through lines 130 allows each output channel to be separately connected to a noise generator 57. The microprocessor 51 also controls the input selector switch 120 through line 121 and input gain adjustment circuits 110, 112, 114 and 116 through lines 118.

A set of audio power amplifiers 52, 54, 56, 58 and 60 receives the output signals of processor 1 and amplifies each for application to a corresponding loudspeaker 62, 64, 66, 68 and 70, respectively, placed surrounding a listening area 72. Within the listening area 72 is placed a microphone 74 for calibration and balancing purposes. A microphone preamplifier and level detector circuit 76 is connected to the microphone through line 75 and provides a DC voltage corresponding to the signal level received by the microphone to the microprocessor 51 via line 77.

The microprocessor 51 also provides a video output through cable 79 to a video display monitor 78 which may be the same video monitor used for presentation of the video signals (if any) from sources 100, 102, 104 and 106. As various calibration and balancing processes are in progress the video display reports their status to the user.

A user interface control system 80 provides control signals to the microprocessor through lines 81 to select various inputs and to initiate calibration and balancing modes. A remote control unit 86 may be used from the listener position to effect inputs to the user interface control system 80.

Figures 3, 6, 8:
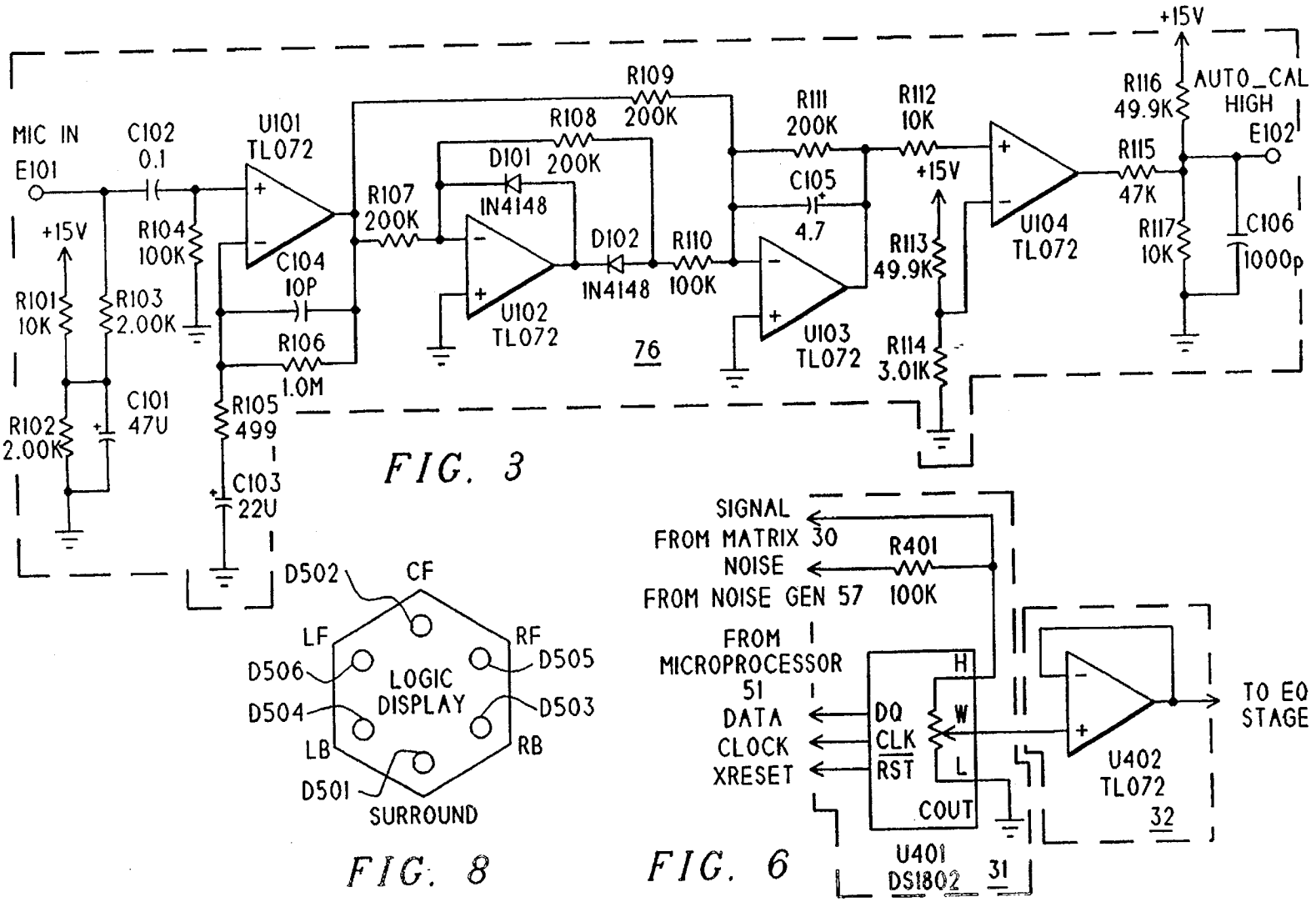
FIG. 3 is a detailed schematic of the microphone preamplifier and level detection circuitry employed in the processor of FIG. 2.
FIG. 6 is a detailed schematic of a typical output level circuit controlled by the microprocessor in FIG. 1.
FIG. 8 is a typical front panel layout for the visual display circuit of FIG. 7.

A visual display 88 is connected via lines 57 to internal circuitry of the core elements contained in block 122 of the processor 1, and is configured to display the relative strengths of the six axis control signals generated by this circuitry on a number of light-emitting diodes arranged in a manner as shown in FIG. 8, to be described below.

The components of FIG. 1 other than the video monitor 78, the microphone 74, remote control 86, power amplifiers 52–60, loudspeakers 62–70 and signal sources 100–106 may all be placed in a common enclosure 108 which is described as a surround sound system controller unit. The user interface 80 is normally within the controller unit 108 and may comprise a panel with a display, controls and a remote control receiver.

Referring to FIG. 2, a block schematic of the surround sound processor 1 is shown for further clarification of the context of the present invention.

In FIG. 2, the surround sound processor 1 is equipped with input terminals 2, 4, for receiving left (L) and right (R) audio input signals respectively. These signals are processed by an input stage, 6, typically containing auto-balancing circuitry such as that shown in FIG. 4 and other signal conditioning circuits, such as level controls and possibly a panorama control as described in other patents or patent applications previously referenced. The output signals from this stage are labeled LT and RT, and are applied via lines 5 to a detector filter 8, and via lines 3 to VCA's 18, 20, 22, 24, 26 and 28 connected through lines 19, 21, 23, 25, 27 and 29 respectively to the separation matrix 30. Although not shown, to simplify the drawing for improved clarity, the inversions of these signals, -LT and -RT may be generated here and also provided via affitional lines 3 to the VCA's 18–28 and separation matrix 30.

The detector filter 8 provides filtered signals LTF and RTF labeled 7 to the inverter 9, the detector matrix circuit 10 and to a detector circuit 12. The signal RTF is inverted by the inverter 9 and also applied to the detector matrix circuit 10. The detector matrix 10 generates outputs 11 labeled FTF and BKF corresponding to front (L+R) and back (L–R) signal directions. These signals are also applied to detector circuit 12, which comprises two identical circuits. One accepts input signals FTF and BKF and produces an output signal F/B at 13, while the other accepts the input signals LTF and RTF to produce an output signal L/R at 13.

The detector output signals 13 labeled F/B and L/R are applied to the detector splitter circuit 14, wherein are produced the three signals 15 labeled LF/RF, FT/BK and LB/RB. These in turn are applied to the servo logic circuit 16 to provide six control voltage signals 17 labeled LFC, RFC, FTC, BKC, LBC and RBC, for controlling the six VCA's 18 through 28, and labeled LF, RF, FT, BK, LB, and RB VCA respectively.

These VCA's receive the LT and RT signals 3 in different proportions, according to the directional matrix they are intended to provide, and apply their output signals 19 through 29 each in both polarities to the separation matrix 30, which also receives the unmodified LT and RT signals 3. As mentioned above, though not shown in FIG. 2, inverters may also be provided for these signals LT and RT to generate -LT and -RT respectively. These inverters may be considered to be a part of the input stage, as their outputs may also be applied to some inputs of VCA's 18 through 28. These details are shown in FIGS. 2–8 of the previously referenced co-pending patent application, as necessary for the understanding of the invention, but are not included in FIG. 2 of this application in order to simplify the diagram and improve clarity.

According to the present invention, outputs from the matrix 30 are passed through the variable attenuators 31, 33, 35, 37, and 39, and are buffered by amplifiers 32 through 40, providing output signals LFO, CFO. RFO, LBO and RBO at terminals 42, 44, 46, 48 and 50 respectively. These form the five standard outputs of the processor 1, but other outputs (not shown) may also be provided. The switches 41, 43, 45, 47 and 49 shown in FIG. 1 are not shown here since they are not part of the basic processor circuitry. Typically, the outputs shown may be provided to electronic crossover components in order to provide subwoofer outputs L-SUB, R-SUB and M-SUB (not shown in FIG. 2) as well as the five outputs shown. Such techniques are well known in the art and need no further explanation here.

The added microprocessor 51 is provided for the purpose of adjusting both input and output circuitry to provide optimally balanced signals from all loudspeakers placed around the listening area (shown in FIG. 1) for any specific preferred listener location. The principles of operation of this circuitry will be discussed in detail with reference to FIGS. 3–11 of this application.

This microprocessor 51 provides signals 128 for adjustment of voltage controlled attenuators 53 and 55 in series with the LT and RT inputs from terminals 2 and 4 respectively to the input stage 6.

Additionally, the microprocessor 51 provides signals 132 for adjustment of the voltage controlled attenuators 31 through 39 for balancing the relative strengths of the acoustic outputs of the loudspeakers driven respectively by the surround sound processor output signals at terminals 42 through 50.

The visual display 88 receives signals 87 from the servo logic block 16, as will be described below with reference to FIG. 7.

Other connections of the microprocessor 51 are not shown in FIG. 2, since they are shown in the more comprehensive FIG. 1 instead.

FIG. 3 is a detailed schematic of the microphone preamplifier and level detector circuitry shown in FIG. 1 as circuit block 76.

In FIG. 3, resistors R101 and R102 provide a DC voltage of +2.5V at their junction, which is decoupled by capacitor C101. Resistor R103 provides this DC voltage to the microphone via terminal E101.

The microphone signal MIC_IN at terminal E101 is AC coupled through capacitor C102 and resistor R104 to the non-inverting input of an operational amplifier U101. The feedback network around this op-amp comprises resistor R105 in series with capacitor C103 from the non-inverting input to ground and resistor R106 in parallel with capacitor C104 from its output to its non-inverting input. The resistor R105 and capacitor C103 roll off the low frequency response, but provide a mid-band gain of about 2000 or 66 dB, and capacitor C104 rolls off the high-frequency signals above the usable frequency range.

The following op-amps U102 and U103 form a conventional full-wave rectifier and integrator, with the associated resistors R107–R111, diodes D101–D102 and capacitor C105. The time constant of the rectifier with the typical component values shown is approximately 1 second.

The DC output voltage from op-amp U103 is compared with a reference voltage of about 0.85V set up by the voltage divider comprising resistors R113–R114, and provides a logical high output through the network comprising resistors R115–R117 and capacitor C106 at terminal E102, labeled AUTO_CAL_HIGH.

Although this circuit is fairly conventional, the values have been optimized for this specific application to provide the proper bandwidth and frequency response for the microphone and the best time constant in the rectifier for the automatic calibration modes controlled by the microprocessor 51 of FIG. 1. These modes will be discussed below with reference to FIG. 11.

Figure 4:
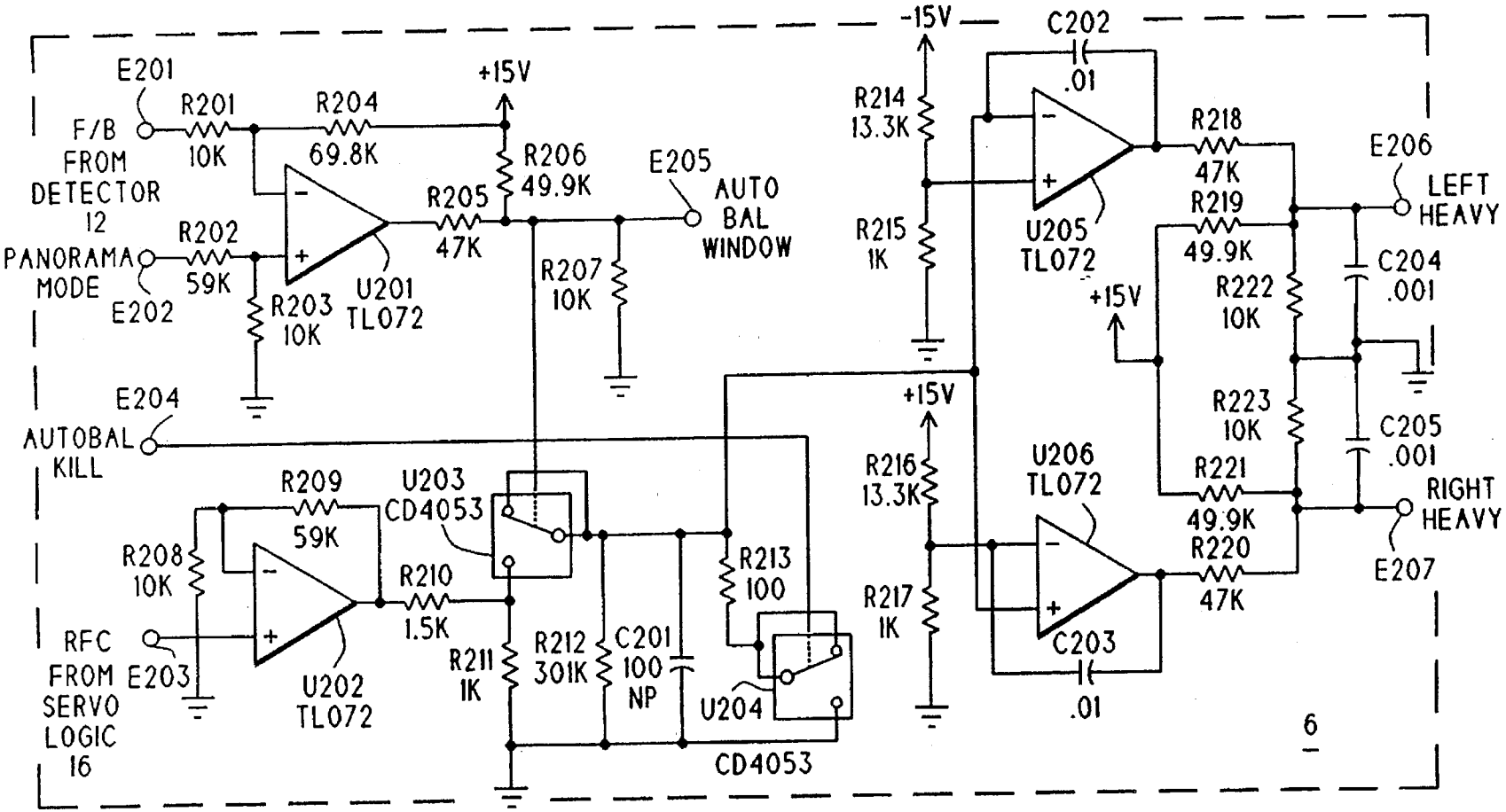
FIG. 4 is a detailed schematic of automatic balance control sense circuitry according to the invention.

Turning to FIG. 4, a portion of the auto-balancing circuit included in the input stage 6 of FIG. 2 is shown. Op-amp U201 is used as a comparator, to compare the voltage at the junction of R201 and R204 with that at the junction of R202 and R203. When a "panorama" mode is selected, the voltage at terminal E202 is high, i.e. at +5V, otherwise it is low, i.e. at 0V. In the panorama mode, therefore, the F/B signal applied to terminal E201 must go less negative than in non-panorama modes in order for the output to go high. When the output is low, i.e. at about −14V, the voltage at terminal E205 is low, near 0V, while when the F/B input goes negative causing the output of op-amp U201 to go high, the voltage at terminal E205 goes high to about 4.23V. Thus, when there is predominant front information present, the AUTO_BAL_WINDOW signal goes high, and informs the microprocessor that balancing is to take place.

This signal also controls the switch U203, connecting the junction of resistor R212 and capacitor C201 to the junction of resistors R210 and R211, which in turn are attenuating the output from op-amp U202. This amplifier responds to the magnitude of the signal RFC from the control voltage generator. When RFC moves positive, the voltage on capacitor C201 increases, provided that switch U203 is turned on, and when RFC moves negative, the voltage on capacitor C201 decreases.

The signal on capacitor C201 is applied to two amplifiers U205 and U206, in opposite senses. Thus when the voltage goes more negative than that at the junction of resistors R214 and R215, which is about −1.05V, the LEFT_HEAVY output at terminal E206 goes to a logical high level, about +4.3V. Similarly, when the output goes more positive than the +1.05V at the junction of resistors R216 and R217, the signal RIGHT_HEAVY at terminal E206 goes to a logical high level.

The purpose of this circuit is to average the degree of balance between the "leftness" and "tightness" of dominant signals when they are in a window between just left of center front and just right of center front. It is common practice to record dialog in movie soundtracks and the vocalist or principal performer in musical recordings precisely at center front, but due to imperfections in the recording and playback chain and sometimes in the media, this balance is not always maintained.

Therefore, when the center front input is found to be "left heavy", the gain of the left input channel may be adjusted downwards (or that of the right channel adjusted upwards) so that the left and right signals are in balance.

Between periods of center front dominant signals, the switch U203 is turned off, and the voltage on capaciter C201 slowly returns toward zero, with a time constant of about 30 seconds. During center front signal dominance periods, the time constant for restoring the signal to the balanced state is about 60 ms.

When desired, the auto balance circuitry can be disabled by applying a logical high level to the terminal E204, which ensures that capacitor C201 is rapidly discharged through resistor R213 and switch U204, and remains discharged for as long as switch U204 is turned on.

In other implementations of the auto-balance circuitry disclosed in previous patents and patent applications by the present inventor, the means for correcting the off-balance condition has been an analog voltage-controlled amplifier or attenuator, and the operational amplifiers U205 and U206 were operated in a linear mode to produce analog LEFT_HEAVY and RIGHT_HEAVY signals to reduce the gains of the left or right channels respectively to the proper values to balance the input signals to the core of the surround sound processor 1 of FIG. 1. This circuit differs from the prior circuits by providing digital inputs to the microprocessor 51 from terminals E205, E206 and E207, so that the gains can be adjusted by digital means to be discussed below with reference to FIGS. 5, 9 and 10.

Figure 5:
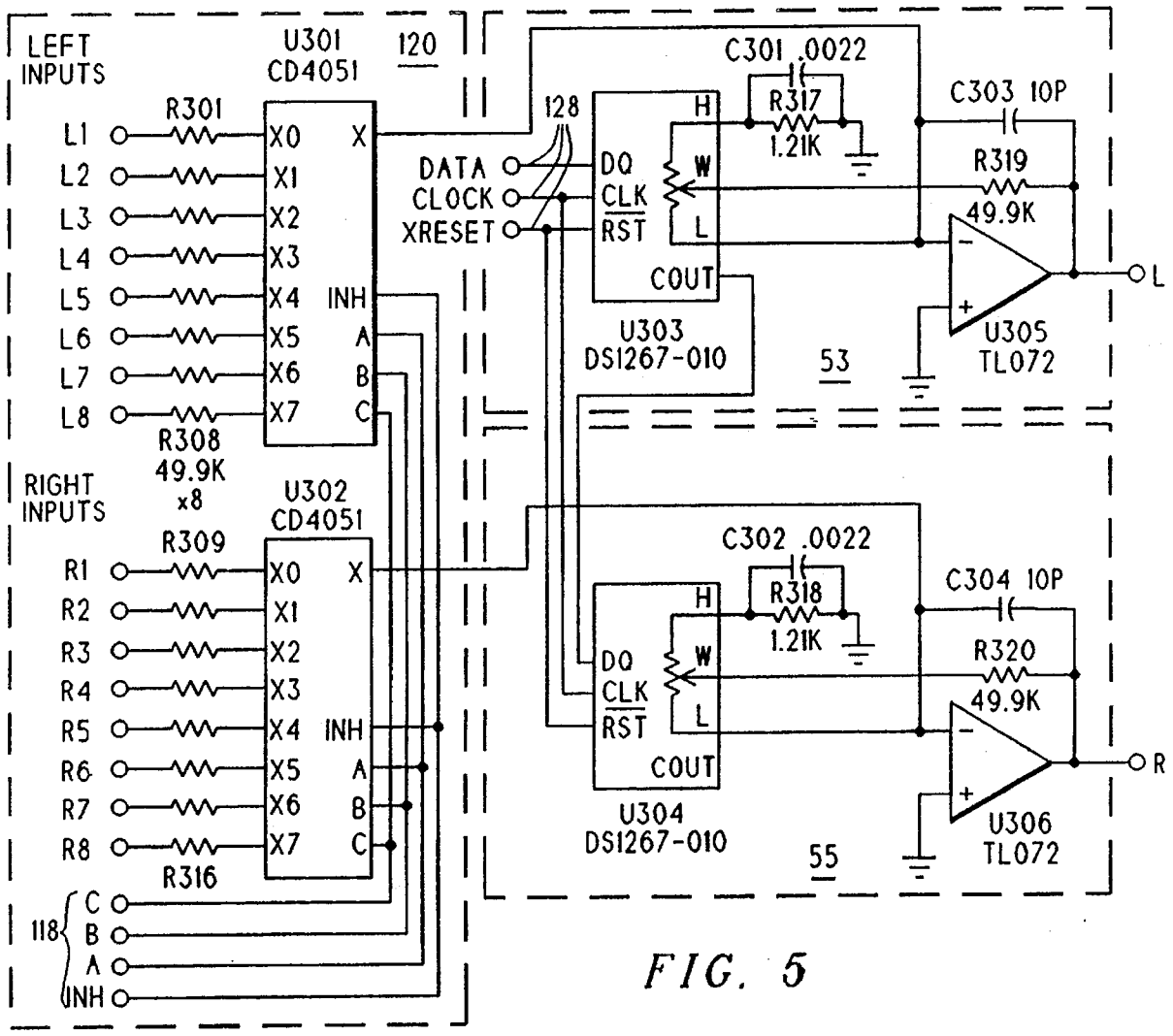
FIG. 5 is a detailed schematic of input selection and level control circuitry employed in the processor of FIG. 1.

Referring to FIG. 5, there is shown a portion of the input circuitry of the surround sound processor control unit 108 of FIG. 1, which includes an analog multiplexer equivalent to the switch 120 of FIG. 1, and a dual channel level control with digitally controlled gain, equivalent to controlled attenuators 53 and 55 shown in FIGS. 1 and 2.

In FIG. 5, two 8-channel analog multiplexers are employed, with common control signals, labeled 118. The signals A, B and C form an octal code 0 to 7 (000 to 111) which selects the corresponding one of the input signal pair, e.g. L1 and R1, or L4 and R4, and switches that pair of signals to the X outputs of the multiplexers. These multiplexers U301 and U302 are of an industry standard type CD4051 (also known under other equivalent type designations from various manufacturers.) The INH signal may be used to prevent any of the inputs from reaching the following stage, i.e. as a muting control. Signals 118 are originated by the microprocessor 51 of FIG. I in response to user selection of the signal source, either from the front panel or remote controls 86. Although not shown, for clarity, in FIG. 5, additional resistors are placed between each of the X1–X7 pins of the multiplexers U301 and U302 and ground, to limit the magnitude of the audio or DC signals that may appear on unused inputs of the IC's.

The digital potentiometers U303 and U304 are a type DS1267–010 available from Dallas Semiconductors, and have a resistance value of about 10 kΩ. In the configuration shown in FIG. 5, the negative feedback current through resistor R319 around op-amp U305 is made to divide between a path through part of potentiometer U303 to the inverting input of op-amp U305, and a path through resistor R318 to ground. This forces the voltage gain of the stage from terminal L1 to terminal L to increase as the wiper W of the potentiometer U303 moves from the L pin of U303 towards the H pin. Capacitors C301 and C303 equalize the gain at audio frequencies and provide a roll-off at higher frequencies.

An advantage of using the digital potentiometers U303 and U304 in conjunction with the multiplexer or selector switches U301 and U302 is that the gain may be set to a precise digitally controlled value for each of the eight inputs provided in a typical surround sound processor. This effectively combines the functions of potentiometers 110, 112, 114, and 116 of FIGS. 1 and 2 with those of potentiometers 53 and 55, so that the room balance may always be optimized and the room acoustic levels standardized for each signal source. An additional advantage of the invention is that the auto balance compensation may be added into the digital control signals for these potentiometers, effecting a considerable saving in parts cost over the corresponding analog implementation.

Turning to FIG. 6, a similar circuit, shown for the left front output, and employing a digital potentiometer U401 is used in each output channel from the surround sound processor core 122, permitting the desired volume level to be added to the level settings derived for each output channel during automatic calibration, the process for controlling these levels being described with reference to FIG. 11 below. In FIG. 6, the digital potentiometer U301 of the output attenuator 31 is Dallas Semiconductor part number DS1802.

The following buffer U402 represents the buffer 32 shown in FIGS. 1 and 2. It is shown as driving an equalization stage, as in many cases such processors are used in THX installations (THX being a system for reproduction of movie soundtracks), and the THX specifications require equalization filters to be available.

Figure 7:
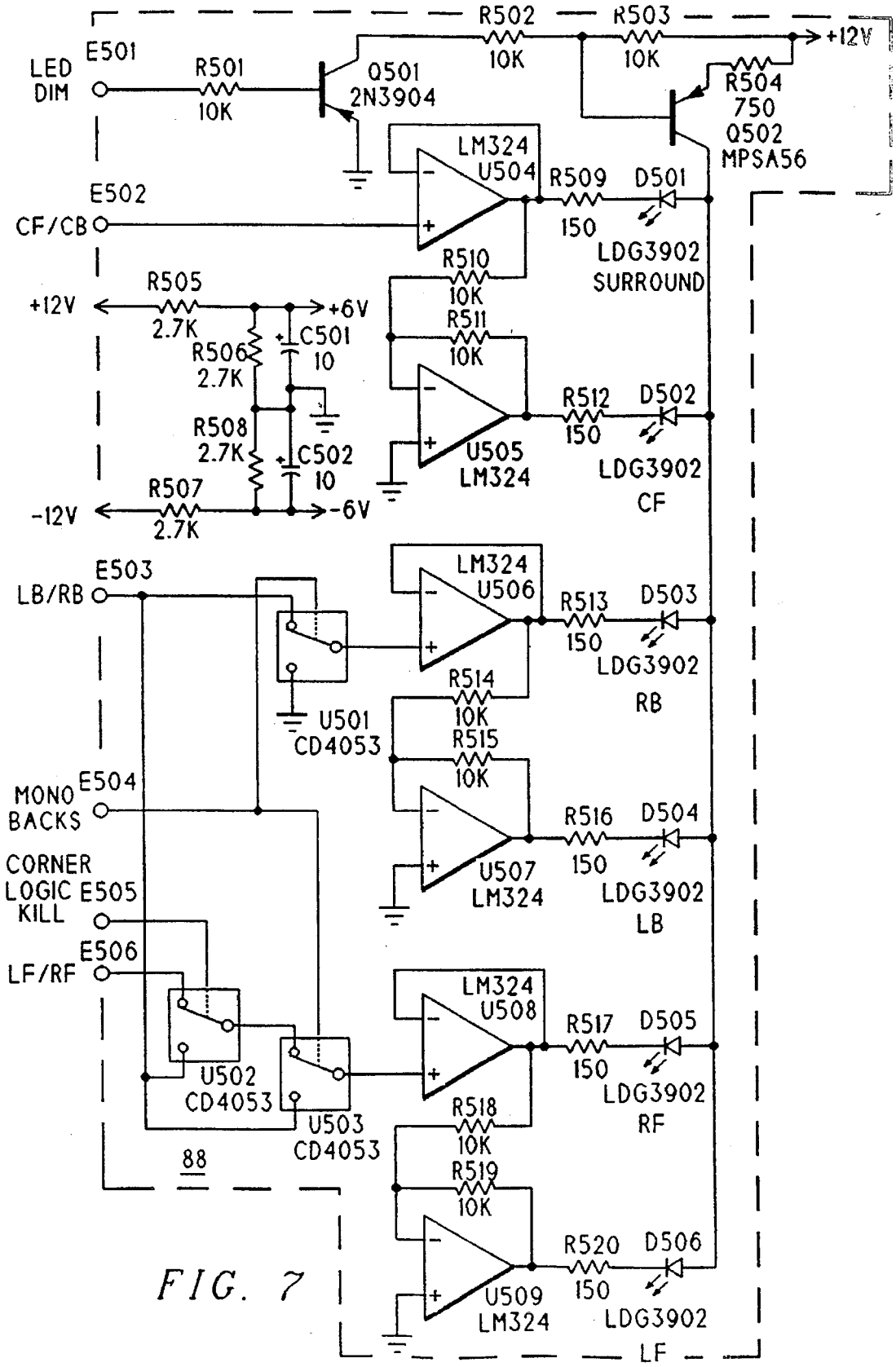
FIG. 7 is a detailed schematic of a visual display circuit according to the invention.

FIG. 7 shows a detailed schematic of a display circuit 88 of FIG. 2 for visually indicating the relative strengths of the various steering signals derived by the control voltage generator of surround sound processor 1. In this circuit, each of the three "split" signals 15 from the detector splitter 14 of FIG. 2 is applied to a buffer and an inverter, to provide six outputs. Each output is tied through a light-emitting diode (LED) to a common transistor Q502 which provides a fixed current to the LED's.

As the corresponding control signal varies in the negative direction, one of LED's D501–D506 shares more or less of this current, and thus the display indicates whichever LED is receiving the highest signal.

The signal LED_DIM applied to terminal E501 in FIG. 7 varies the brightness of the display by changing the current supplied through transistor Q502 to the LED's D501–D506.

The signal CF/CB applied to terminal E502 is always used, buffer U504 providing a signal to "SURROUND" LED D501 through resistor R509. The inverter comprising op-amp U505 with resistors R5 10 and R511 provides current to "CF" LED D502 through resistor R512. To avoid damage to the LED's when reverse voltages are present, signal diodes (not shown) may be placed in anti-parallel with each of the LED's D501–D506.

The LB/RB signal applied to terminal E503 is connected through a CMOS switch such as the industry standard CD4053 type to buffer U506 and inverter U507, which provide the "RB" and "LB" LED's D503 and D504 with current through resistors R513 and R516 respectively. When switch U501 is off, which occurs when the signal MONO BACKS applied to terminal E504 is high, the input of buffer U506 is grounded and LED's D503 and D504 are not lit.

The LF/RF signal applied to terminal E507 passes through switches U502 and U503 to the buffer U508 and inverter U509, which provide currents to the "LF" and "RF" LED's D505 and D506 through resistors R517 and R520. When the MONO_BACKS signal is high, switch U503 causes these LED's to respond to the LB/RB input, as the processor is in the 4-axis mode and the split signals are effectively canceled out. When the CORNER_LOGIC_KILL signal applied to terminal E506 goes high, once again the RB/LB signal becomes the input for the buffer U508, and in this case no left-right logic is produced so that all four of the LED's D503–D506 remain off.

A typical arrangement of the LED's D501–D506 is shown in FIG. 8, with the directions LB, LF, CF, RF, RB, and SURROUND in appropriate positions on the display panel, these labels being also shown in FIG. 7. The LED's may be a standard 5 mm×2 mm rectangular type such as Siemens LDG3902 (green), or any available type. Alternatively, other forms of display technology such as vacuum fluorescent displays may be used with minor variations of the circuitry of FIG. 7.

Figure 9:
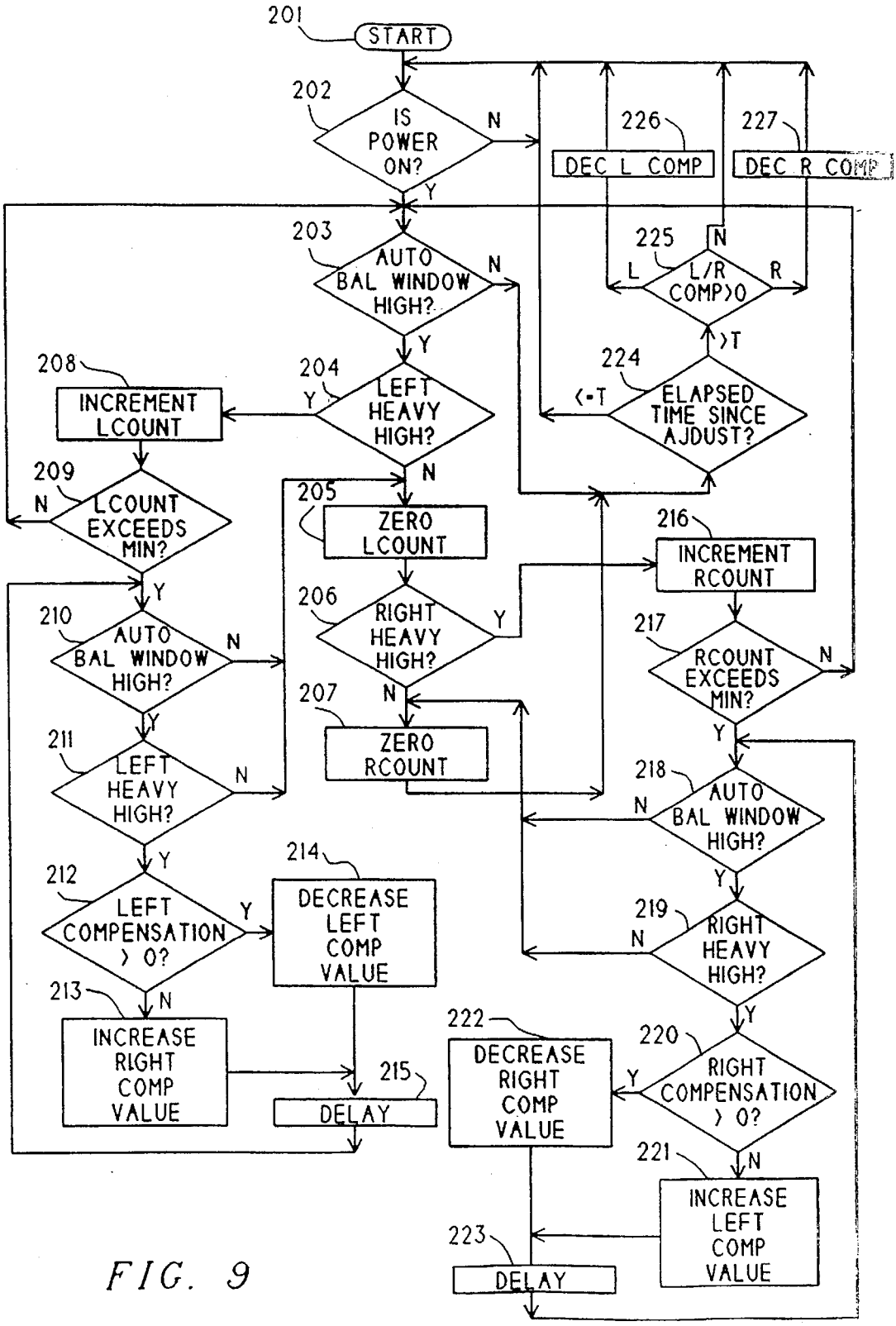
FIG. 9 is a flow chart describing the algorithm for automatic balancing of input signals using the sense circuitry of FIG. 4, according to the invention.

Turning to FIG. 9, there is shown a flow chart for an algorithm for correcting the balance between left and right channels in accordance with the signals received by microprocessor 51 from the auto-balance sense circuit of FIG. 4.

It should be noted that this process is always in effect whenever a stereophonic signal is being processed. Even though modern source equipment such as video disc players and CD players are manufactured and designed to provide exactly equal left and right channel gains, the accumulated variations in balance for instruments and vocals in the recording studio or live performance may result in various degrees of off-balance signals, these variations typically changing even from track to track on the same CD. Therefore, to maintain the best possible surround sound processor performance at all times, it is necessary to constantly check and adjust the balance.

The out-of-balance detection circuitry has already been described with reference to FIG. 4. This circuitry provides the logical signals AUTO_BAL_WINDOW, LEFT_HEAVY and RIGHT_HEAVY to the microprocessor, which then adjusts the auto-balance compensation applied to digital potentiometers 53 and 55 as was explained by reference to FIG. 5. The overall gain value determined by the microprocessor for each input channel is a combination of the desired input gain for a signal level into the processor core 122 at the reference level and the compensation applied for auto-balancing purposes.

The steps of the algorithm are as follows. Entering the continuous loop at the point 201 labeled START, the status of the system power is checked in test 202, and if the power is off, no action will be taken to implement any auto-balancing process. It must be remembered that typically the system power is turned off, but the microprocessor and the remote control receiver are always powered up.

When the system power is turned on, various initialization procedures occur although not shown in FIG. 9, and once the system is in a mode capable of playing back a stereo signal, the auto balance circuit is switched on.

The AUTO_BAL_WINDOW signal is periodically checked in test 203 to see if it is high, and if not, in general, the loop will continue to check both the power status and the status of the AUTO_BAL_WINDOW signal.

During any period when the signal AUTO_BAL_WINDOW is high, the signals LEFT_HEAVY and RIGHT_HEAVY are periodically checked by tests 204 AND 206 to see if either is active. A certain minimum number of consecutive samples of these signals is taken before any action is initiated, to avoid spurious changes due to minor glitches which may occur. Thus for each of the left and right cases a counter variable is continually reset to zero in blocks 205 and 207 while there is no error. Again, in general, the procedure cycles through all of steps 202–207 when the AUTO_BAL_WINDOW signal is high.

If the LEFT_HEAVY signal is high, the left count is incremented in box 208, and checked in test 209 to see if it reaches the minimum number of samples required before action is taken. If not, the cycle continues to check for AUTO_BAL_HIGH and to increment the left count as appropriate.

Once the left count LCOUNT has reached the minimum number MIN, test 209 branches to the lower loop of FIG. 9. Again, AUTO_BAL_WINDOW is checked in test 210 to see if it remains high, and LEFT_HEAVY is also checked in test 211 to see if it remains high. In test 212, if the compensation previously applied to the left channel to increase its gain is non-zero, it is decreased in box 214, otherwise compensation is added to the right channel in box 213 to increase its gain. So that this compensation occurs gradually, some delay 215 is introduced before returning to the comparison at test 210. If the LEFT_HEAVY signal again goes low at test 211, the process will branch to box 205 and zero the left sample count, and this action will also occur if the test 210 fails.

The compensation applied is limited to a maximum value, not shown in FIG. 9, so as to reduce the possibility of inappropriate correction for a signal that is truly left of center.

A similar scheme applies the situation where the RIGHT_HEAVY signal is high, in this case first reducing the right channel compensation and then increasing the left channel compensation until the RIGHT_HEAVY signal goes low again.

In FIG. 9, if test 206 determines that the RIGHT_HEAVY signal is high, the right sample count variable is incremented in box 216 and checked in test 217 until it reaches the MIN value. If the AUTO_BAL_WINDOW remains high in test 218, and the RIGHT_HEAVY signal stays high in test 219, test 220 determines whether there is any right channel compensation, so that box 222 can decrease it, or if not, box 221 increases the left compensation. Again, a delay 223 is included to keep the variation slow. The loop is broken if either the AUTO_BAL_WINDOW signal goes low at test 218, or the RIGHT_HEAVY signal goes low at test 219.

Once both LEFT_HEAVY and RIGHT_HEAVY are low during periods when AUTO_BAL_WINDOW is high, the unit is in balance. The total amount of compensation is then very gradually reduced over a long time period, so that there is a way for the circuit to restore the balance to the nominal condition.

This is achieved by checking for a certain elapsed time since the last auto balance adjustment in test 224 which will normally return to the main loop. If the elapsed time exceeds the set value T, the left and right compensation values are checked in test 225 to see which is non-zero (only one can be at any given time) and that value is decremented in either box 226 or 227. After this, or if both compensation values were zero, the main loop is re-entered at test 202.

It will be understood that the microprocessor 51 performs this task continuously, but is also available to monitor and update many other parameters of the processor during periods when it is not attending to these tasks.

Figure 10:
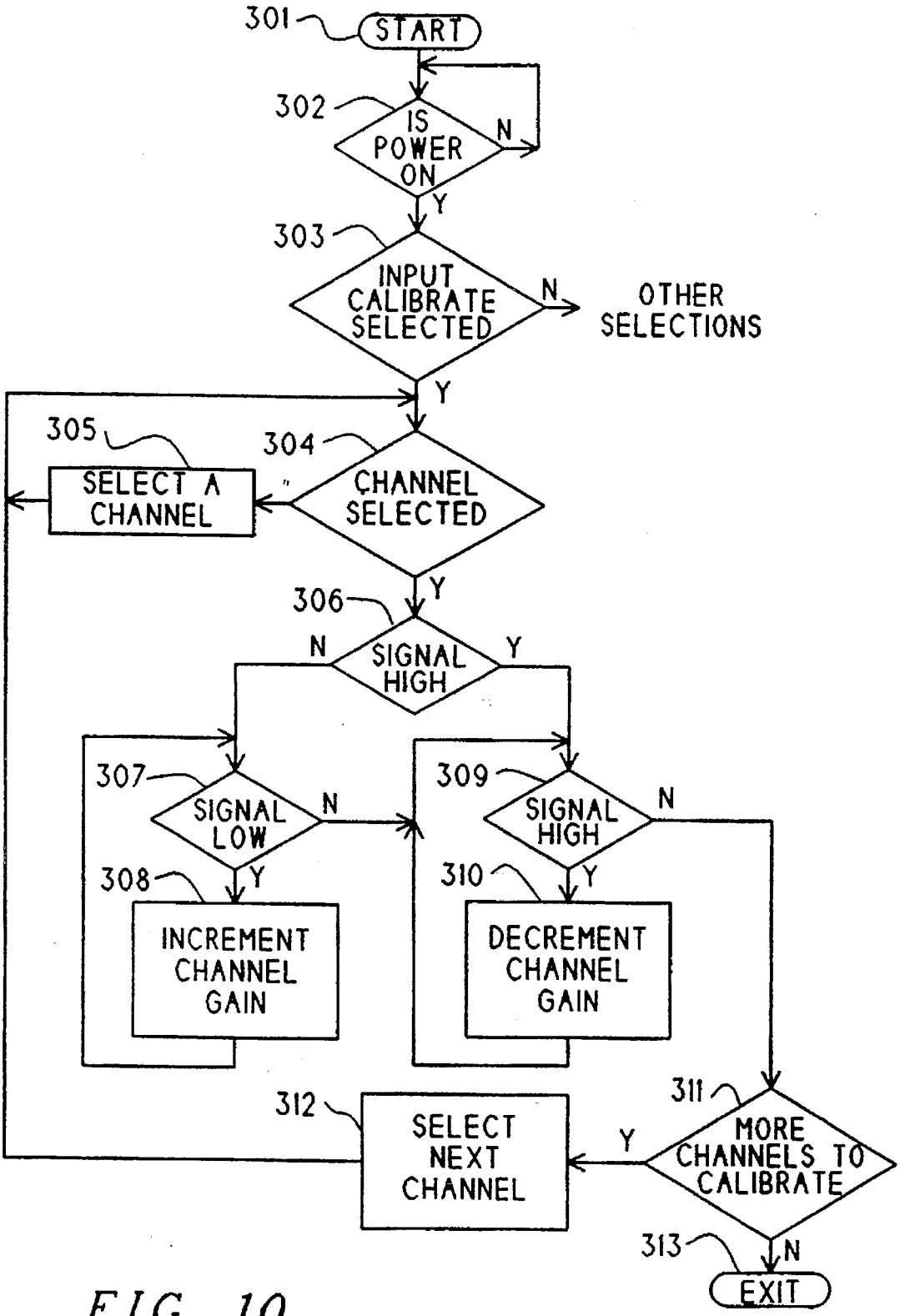
FIG. 10 is a flow chart descriptive of the input level adjustment algorithm employed in the processor of FIG. 1.

Turning to FIG. 10, a flow chart is shown for automatic input calibration and gain setting.

For a typical source, there is normally a calibration level, such as the "Dolby level" for audio tapes, and similarly for movie sound and other media. The object of the calibration process is to set the internal gain of the input to the system to a suitable value to make the signal peak levels equal the Dolby or other reference signal level.

In some situations, there is no available reference level, and the system must estimate the level by averaging the level of the material being played.

The basic algorithm for input level calibration is (for the left and right channels of each input selection) to first apply a reference signal to those inputs. The microprocessor samples the signal levels at the inputs, with auto balance disabled by use of the signal AUTOBAL_KILL shown in FIG. 4, and gradually increases the channel gain until it exceeds the reference level. If the gain was originally too high, the gain is reduced until the signal level falls below the reference, then increased until it just exceeds the reference level.

During this process, the source material may be music, rather than conventional test tones or noise, so the determination of a representative level becomes more complicated. The data is filtered to ensure that a certain number of samples must be either above or below the reference level. A single erroneous sample cannot cause the calibration to be altered.

If the sensitivity cannot be increased enough to raise the signal level to the reference level, or if it is too high and cannot be reduced enough, the original value is restored and an error message is shown on the video screen.

With these precautions in mind, then, the tests for signal level high or low (in relation to the reference level) are generally tests involving a relatively large number of samples that result in a representative averaging of the signal level, rather than a simple instantaneous level comparison or short-term average comparison.

In FIG. 10, the algorithm is entered through the START terminal 301 and includes the power on test 302 which loops back without taking any action if the power is off. Test 303 determines if the input calibration mode has been selected, and transfers control to other mode selections if not.

In test 204 if an input channel has not been selected, flow is transferred to block 305 where a signal source may be selected by the user. Typically, a screen will appear on the monitor showing the possible selections and requesting a choice from the user, which may be entered through the control panel 80 or the remote control 86 of FIG. 1.

The channel selected should have a representative signal being played, such as a Dolby level test tone, or as has been mentioned above, a representative music sample. If the signal level is too high initially, control is transferred by test 306 to the right branch, otherwise it is transferred to the test 307 in the left branch. As long as the signal is below the reference level, block 308 increments the channel gain. This process takes place gradually, to give the microprocessor adequate time to respond and measure the new input signal level. When the level has increased to the reference level, control will again transfer to the right branch.

In this branch, if the signal level is higher than the reference level at test 309, the channel gain will be gradually reduced in block 310 until it once again falls below the reference level. Although not shown, a further loop may be added to finally increase the gain once more to just exceed the reference level. The gain thus found is stored by the microprocessor for the selected channel.

When the gain has been adjusted, test 311 determines if another channel is to be tested, e.g. if the first signal was the left input of a stereophonic pair, the second channel to be tested would usually be the corresponding right input. If another channel is to be tested, the same procedure is followed for this other channel, after selecting the channel in block 312. Otherwise, the algorithm is terminated as the process branches to the EXIT terminal 313.

Although not shown in FIG. 10, additional sanity checks are performed; if the input sensitivity cannot be amplified enough to reach the reference level, or if it is too high and cannot be reduced enough to reach the reference level, an error message is generated and the controls are reset to their original or default values.

Figure 11:
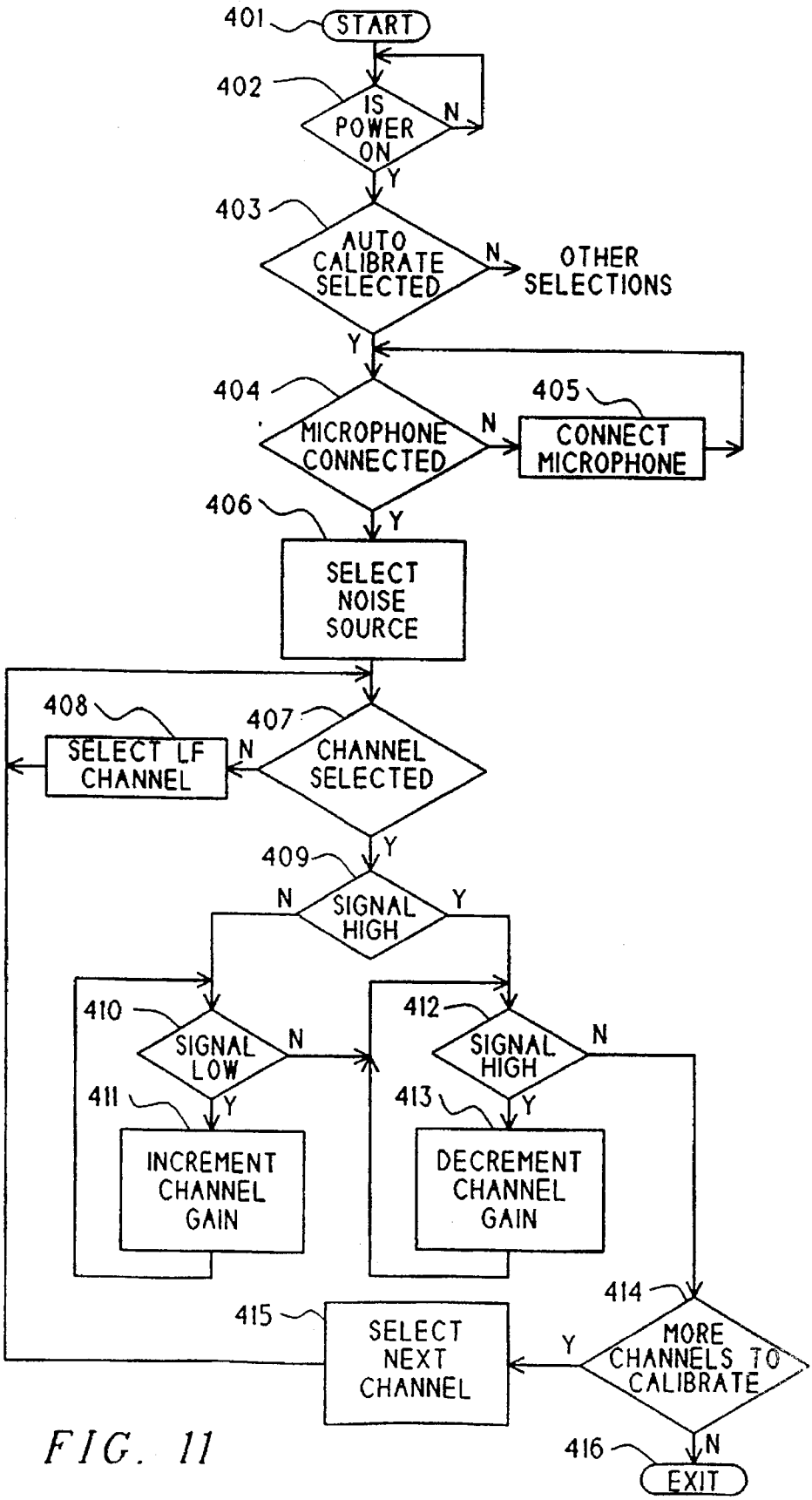
FIG. 11 is a flow chart descriptive of the output level calibration algorithm employed using the microphone and microprocessor of the invention according to FIG. 1.

FIG. 11 shows a flow chart of the algorithm for setting up and balancing the listening room, relying on a microphone to determine the acoustic levels in the vicinity of the "ideal" listening position.

The algorithm is similar to that of FIG. 10. In many surround processors, including the present circuit, a noise generator and sequencer are standard equipment, to aid in setting up the room. However, the adjustment is done manually, by ear, adjusting each output level sequentially to the some acoustic level at the listener's position. The novel addition here is the use of a microphone and detector circuit of FIG. 3, which then permits the microprocessor to adjust all five of the gain values to ensure the proper balance for all the output channels, with their power amplifiers and loudspeakers.

In the algorithm, the output level is gradually raised until it exceeds the reference level, then reduced until it falls below it, and finally is set to give the correct gain value for each individual source by taking the average of the readings.

Each channel and loudspeaker are tested in this way, and the input amplifier gains are adjusted to provide the same input level regardless of the signal source.

In FIG. 11, the algorithm is entered through terminal 401 and again the power status is checked in test 402. If the AUTO-CALIBRATE mode is selected when checked in test 403, the system checks in test 404 whether the measurement microphone is connected.

If it is not, a message will be displayed asking the user to connect and position the microphone, otherwise the noise source is selected in block 6 and a test 407 checks whether an output channel selection has been made. If not, the left front (LF) channel is selected in block 208, and the noise source is then cycled through all of the channels performing the levelling as described previously with reference to FIG. 10. These channels are the CF, RF, RB, LB and CB channels respectively. When all channels have been tested, the algorithm exits through terminal 416.

The use of a microprocessor in the system allows for easier user interaction and for precise adjustment of the appropriate parameters of the listening environment for the best possible presentation of a multichannel redistribution of sound among a number of loudspeakers surrounding the listener. At the same time, the audio quality is maintained at its best by employing a purely analog signal path except in the rear channels in those modes where a digital delay is used. In the above case, the microprocessor displays information to the user as calibration is in progress, indicating which loudspeaker is being calibrated, in accordance with the speaker setup that has been previously entered in the installation menu. If any wiring errors occurred, or the wrong configuration was entered, this will be apparent during the calibration procedure.

While the preferred embodiments have been detailed above, it will be apparent to those skilled in the art that many modifications and adaptations of the circuitry and algorithms presented can be made, without departing from the spirit of the invention, as set forth in the specification, claims, and figures.

What is claimed is:

1. A surround sound processor system including a control unit for multichannel redistribution of sound for reproduction by a plurality of loudspeakers surrounding a listener, comprising;

a plurality of stereo audio inputs for receiving stereo audio signals from one or more source units;

a selection means for selecting one of said plurality of stereo audio signals as a left and a right channel audio input signal;

a digitally controlled gain adjustment circuit in each of said left and right channels for controlling the amplitudes of said left and right audio input signals;

a surround sound processor for combining said left and right audio input signals in fixed and varying proportions according to the directional information contained therein as a result of the instantaneous relative magnitudes and phases of said left and right audio input signals which is detected by a direction detector circuit, said surround sound circuit comprising a a matrix circuit for combining said left and right audio input signals, said matrix circuit including voltage controlled amplifiers which are controlled by a multiplicity of control voltage signals derived from the output signals of said direction detector circuit after said control voltage signals have passed through a detector splitter and a servologic circuit for controlling the attack and decay time constants associated therewith, to provide at the outputs of said surround sound processor a plurality of loudspeaker drive signals;

a plurality of digitally controlled attenuator circuits equal to said plurality of loudspeaker drive signals for adjustment of the output signal level of each of said digitally controlled attenuator circuits;

a calibration signal source;

a microphone for placement at a point in the area surrounded by said plurality of loudspeakers;

a preamplifier and level detector circuit for receiving the input from said microphone and producing therefrom a direct voltage proportional to the sound intensity at the location of said microphone and converting said direct voltage to a digital signal; and a microprocessor controller so configured in a calibration mode as to receive said digital signal from said microphone and to automatically adjust the gains of each of said plurality of digitally controlled attenuators when the output of said calibration signal is applied thereto so that the sound intensity due to each of said plurality of loudspeakers at the microphone position is the same.

2. The system of claim 1 wherein said microprocessor controller is configured in an input level calibration mode to measure the amplitudes in each of left and right channels of the selected one of said plurality of stereo audio signals from said sources when a reference signal is applied thereto at a standardized level, and to adjust the gains of said digitally controlled gain adjustment circuits so that the levels of said left and right audio signals applied to said surround sound processor are equal to a prescribed reference level.

3. The system of claim 2 wherein the appropriate digital words corresponding to the required gain of each of said digitally controlled gain adjustment circuits for each of said plurality of stereo audio signals are retained in the memory of said microprocessor controller for initial setting of the gain of each of said digitally controlled gain adjustment circuits each time a specific one of said signal sources is selected by said selection means.

4. The system of claim 1 further comprising an automatic balancing detector responsive to the relative magnitudes of left and right signals that are almost equal and in phase and providing therefrom a first logical control signal indicating the presence of nearly equal in-phase signals, a second logical control signal indicating that the left signal is significantly stronger than the right signal, and a third logical control signal indicating that the right signal is significantly stronger than the left signal; and wherein said microprocessor controller may be configured in a signal playback mode to constantly monitor said first, second and third logical control signals and continually adjust incrementally the gains of said left and right channel digitally controlled gain adjustment circuits according to a predetermined method so as to cause such nearly equal in-phase left and right signals to be brought into balance and maintained in balance.

5. The system of claim 4 wherein said predetermined method comprises the steps of:

determining when said first logical control signal is high;

during a period when said first logical control signal is high corresponding to the presence of nearly equal in-phase left and right audio input signals, determining whether either of said second or third logical control signals is high and remains high for a specified minimum number of sample times;

whenever said second or third logical control signal has remained high for more than the specified number of sample times, first gradually reducing the incremental gain compensation added to the one of the left or right channels which has the higher signal level, if any, and then adding incremental gain compensation to the channel which has the lower signal level, until the one of said second or third logical control signals that was high becomes low, or until said first logical control signal goes low, or until a maximum amount of incremental gain compensation has been added; and after a balanced condition has been reached, or said first logical control signal has gone low, or said maximum amount of incremental gain compensation has been added, very gradually reducing the incremental gain compensation that has been added until the said second or third logical control signals again begin to go high when said first logical control signal goes high, indicating that sufficient imbalance between the left and right input audio signals exists to recommence automatic balancing of the signals.

6. The system of claim 1 wherein said calibration signal source is a weighted noise source.

7. The system of claim 1 wherein the method for adjustment of each of said plurality of digitally controlled attenuators comprises the steps of:

monitoring the sound intensity at the location of said microphone by comparing the said digital signal representing the sound intensity with a reference value;

if the sound intensity is initially too low, gradually increasing the incremental gain compensation applied to the said digitally controlled attenuator until the sound intensity is higher than the reference value;

otherwise, or when the sound intensity has been made higher than the reference value, gradually decreasing the incremental gain compensation until the sound intensity falls just below the reference value, then increasing the incremental gain compensation until the sound intensity just exceeds the said reference level;

or, if the sound intensity cannot be adjusted to be just above the said reference level, restoring the original incremental gain adjustment settings and indicating to the user that the attenuator cannot be set to the desired level; and proceeding to the next in sequence of the said plurality of loudspeaker drive signals to adjust its gain in the same manner;

until all the loudspeaker drive signals' attenuator means have been adjusted to the proper levels.

8. The system of claim 2 wherein the method for adjustment of the digitally controlled gain adjustment circuits in each of the left and right stereo audio inputs comprises the steps of:

monitoring the audio signal level by comparing it with a reference value;

if the audio signal level is initially too low, gradually increasing the incremental gain compensation applied to the said digitally controlled gain adjustment means until the audio signal level is higher than the reference value;

otherwise, or when the audio signal level has been made higher than the reference value, gradually decreasing the incremental gain compensation until the audio signal level falls just below the reference value, then increasing the incremental gain compensation until the audio signal level just exceeds the said reference level;

or, if the audio signal level cannot be adjusted to be just above the said reference level, restoring the original incremental gain adjustment settings and indicating to the user that the digitally controlled gain adjustment means cannot be set to the desired level; and proceeding to the next in sequence of the said left and right audio input signals to adjust its gain in the same manner;

until both digitally controlled gain adjustment means have been adjusted to the proper levels.

9. The system of claim 8 wherein audio signal level further comprises the average signal level of a varying audio signal as determined by a method comprising the steps of:

comparing samples of the signal level with a reference level in hardware to determine that a certain minimum number of consecutive samples has either exceeded or not exceeded the reference level or that equal numbers have exceeded and have not exceeded the reference level in a given period of time;

but discarding any single samples which greatly exceed or fall below the expected range of values so that a single erroneous sample cannot cause an averaging error; and if the numbers of high and low samples are equal, adjusting the gain higher after a certain interval has passed.

10. The system of claim 1 further comprising:

a visual display for indicating the relative magnitudes of each of the said multiplicity of control voltage signals therein.

11. The system of claim 10 wherein said visual display comprises:

a plurality of light-emitting diodes equal to said multiplicity of control voltage signals, each in series with a resistor connected to its cathode, the anodes of said light-emitting diodes being connected to a common point;

a like plurality of operational amplifiers whose outputs are each connected to the said series resistor connected to the cathode of a different one of said light-emitting diodes;

a first one of said operational amplifiers being connected as a unity gain buffer having its input connected to the one of said control voltage signals which goes negative in the presence of equal out-of-phase signals in the said left and right audio input channels;

a second one of said operational amplifiers being connected as a unity gain inverter whose input is connected to the output of said first one of said operational amplifiers, such that its output goes negative in the present of equal in-phase signals in said left and right audio input channels;

a third one of said operational amplifiers being connected as a unity gain buffer having its input connected to the one of said control voltage signals which goes negative in the presence of signals exclusively in the said left audio input channel;

a fourth one of said operational amplifiers being connected as a unity gain inverter whose input is connected the output of said third one of said operational amplifiers, such that its output goes negative in the presence of signals exclusively in the said right audio input channel;

a fifth one of said operational amplifiers being connected as a unity gain buffer whose input is connected to the one of said control voltage signals which responds such that its output goes negative to a combination of a larger amplitude left signal in combination with a smaller amplitude out-of-phase right signal; and a sixth one of said operational amplifiers being connected as a unity gain inverter whose input is connected to the output of said fifth one of said operational amplifiers, such that its output goes negative in response to a combination of a larger amplitude right signal in combination with a smaller amplitude out-of-phase left signal;

said common point being connected to a collector of a transistor which provides a constant total current to said light-emitting diodes that is variable in response to a direct voltage applied to its base for the purpose of adjusting the overall brightness of the light-emitting diodes.

12. The system of claim 10 wherein the input of said third operational amplifier of said visual display may be switched to ground in order to cause the light-emitting diodes connected to the outputs of said third and fourth operational amplifiers to remain unlit.

13. The system of claim 10 wherein the input of said fifth operational amplifier of said visual display and that of said third operational amplifier may be switched to be connected in common to said control voltage signal negatively responsive to the presence of signals only in the left audio input channel.

* * * * *